US006730895B2

(12) United States Patent
Kim

(10) Patent No.: US 6,730,895 B2
(45) Date of Patent: May 4, 2004

(54) MICROWAVE OVEN

(75) Inventor: Haug-Ki Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/357,371

(22) Filed: Feb. 4, 2003

(65) Prior Publication Data

US 2004/0040954 A1 Mar. 4, 2004

(30) Foreign Application Priority Data

Aug. 29, 2002 (KR) ..... 2002-51627

(51) Int. Cl.[7] ..... H05B 6/64

(52) U.S. Cl. ..... 219/682; 219/731; 219/754

(58) Field of Search ..... 219/678, 682, 219/680, 681, 687, 688, 725, 730, 731, 736, 756, 762, 763, 686, 735, 751, 752, 754, 755; 99/DIG. 14, 330, 331, 443 R; 426/113, 234, 243; 126/338, 339

(56) References Cited

U.S. PATENT DOCUMENTS 5,229,563 A * 7/1993 Isogai et al. ..... 219/735
5,796,082 A * 8/1998 Kim ..... 219/752
6,469,287 B1 * 10/2002 Kim ..... 219/751

FOREIGN PATENT DOCUMENTS

JP 8135979 5/1996

* cited by examiner

*Primary Examiner*—Tu Ba Hoang
(74) *Attorney, Agent, or Firm*—Staas & Halsey LLP

(57) ABSTRACT

A microwave oven is provide, which is capable of steaming food and cooking food by direct-irradiation of microwaves at a same time, and is capable of keeping a cooking cavity clean. A water container is arranged at an upper portion of the cooking cavity to generate steam from water contained in the water container when the water is heated by the microwaves. A water supplying guide and a steaming container are arranged at an upper portion of the housing. The steaming container comprises a body and a lid. A food supporting tray with a plurality of steam holes formed therethrough is placed in the body of the steaming container such that the food to be cooked is placed on the food supporting tray. Steam holes formed on a bottom surface of the body are bored in lugs upwardly projected from the bottom surface, and are arranged so as to be eccentric from the plurality of steam holes of the food supporting tray. Thus, water and oil produced from the food placed on the food supporting tray pass through the plurality of steam holes of the food supporting tray and are collected on the bottom surface of the body.

38 Claims, 4 Drawing Sheets

MICROWAVE OVEN

CROSS-REFERENCE TO RELATED APPLICATION

This application claims the benefit of Korean Application No. 2002-51627, filed Aug. 29, 2002, in the Korean Intellectual Property Office, the disclosure of which is incorporated herein by reference.

BACKGROUND OF THE INVENTION

1. Field of the Invention

The present invention relates, in general, to microwave ovens and, more particularly, to a microwave oven which is designed such that a water container is arranged at an upper portion of a cooking cavity and a steaming container is arranged at an upper portion of a housing, thus steaming food and cooking the food using microwaves at a same time, and thus keeping an interior of the cooking cavity clean after steaming the food.

2. Description of the Related Art

As is well known to those skilled in the art, a microwave oven is an appliance which heats and/or cooks food placed in a cooking cavity thereof using high-frequency electromagnetic waves generated by an oscillation of a magnetron installed in a machine room. That is, during a cooking process, the magnetron installed in the machine room of the microwave oven irradiates microwaves throughout the cooking cavity. The microwaves penetrate the food so as to repeatedly change a molecular arrangement of moisture laden in the food, thus causing molecules of moisture to vibrate and generating frictional heat within the food to cook the food.

The microwave oven is provided in the cooking cavity thereof with a turntable-type cooking tray. The turntable-type cooking tray is rotated at a low speed such that microwaves evenly irradiate the food placed on the turntable-type tray to cook the food. Thus, the typical microwave oven cannot cook the food using steam.

Further, when cooking food using steam in the microwave oven is desired, a water container must be provided in the cooking cavity to generate the steam. Accordingly, water contained in the water container is heated by the microwaves to generate the steam. The food is cooked using the steam generated from the water contained in the water container.

FIG. 1 is a schematic sectional view showing a conventional microwave oven, with a steaming container installed in a cooking cavity.

As shown FIG. 1, the conventional microwave oven with water containers includes a cooking cavity 1, magnetrons 2*a* and 2*b*, and a holder 5. The cooking cavity 1 defines a space to cook food 3. The magnetrons 2*a* and 2*b* to generate microwaves are externally installed on upper and lower portions of the cooking cavity 1, respectively. The holder 5 is installed in the cooking cavity 1 to hold a food shelf 7 to seat the food 3 thereon and hold first and second water containers 4*a* and 4*b*.

The first water container 4*a* is held on the holder 5 at a position above the food shelf 7, and the second water container 4*b* is held on the holder 5 at a position below the food shelf 7. Water absorbing materials 6*a* and 6*b* are put in the first and second water containers 4*a* and 4*b*, respectively, to generate steam by the microwaves irradiated from the magnetrons 2*a* and 2*b*. Thus, when the magnetrons 2*a* and 2*b* are operated, the microwaves irradiate the water absorbing materials 6*a* and 6*b* provided in the first and second water containers 4*a* and 4*b* and heat the water laden in the water absorbing materials 6*a* and 6*b* to generate high-temperature steam. At this time, the high-temperature steam is transmitted to the food 3 to cook the food 3.

However, the conventional microwave oven with the water containers is constructed such that the water containers and the holder to hold the water containers are installed in the cooking cavity so as to enclose an entire space of the cooking cavity. Thus, in a case of steaming the food in the microwave oven, to cook the food by direct-irradiation of the microwaves is not possible. On the contrary, in a case of cooking the food by the direct-irradiation of the microwaves, to steam the food 3 is not possible. Thus, the conventional microwave oven with the water containers has a problem such that to cook the food by the direct-irradiation of the microwaves and to cook the food using the steam generated from the water by the microwaves at the same time is not possible.

The conventional microwave oven with the water containers has another problem such that one or more water containers are arranged on upper and lower portions in the cooking cavity, respectively, and food to be steamed is placed between the water containers, so that water and oil produced from the food are discharged into the cooking cavity while steaming the food, thus making the cooking cavity dirty, therefore inconveniently necessitating cleaning of the cooking cavity, as well as the steaming container, to make the cooking cavity and the steaming container clean after steaming the food.

SUMMARY OF THE INVENTION

Accordingly, it is an aspect of the present invention to provide a microwave oven, which is designed such that a water container is arranged at an upper portion of a cooking cavity and a steaming container is arranged at an upper portion of a housing, thus simultaneously allowing one food to be placed in the steaming container arranged at the upper portion of the housing and another food to be placed on a turntable-type cooking tray mounted on a lower portion of the cooking cavity, thereby steaming the one food and cooking the other food by the direct-irradiation of microwaves at the same time.

Another aspect is to provide a microwave oven, which is designed such that water and oil produced from the food during steaming are collected in the steaming container, thus keeping the cooking cavity clean.

Additional aspects and advantages of the invention will be set forth in part in the description which follows and, in part, will be obvious from the description, or may be learned by practice of the invention.

The foregoing and/or other aspects are achieved by providing a microwave oven, including a housing, and a cooking cavity provided in the housing and open at a front thereof, wherein a water container is arranged at an upper portion of the cooking cavity to generate steam from water contained in the water container when heated by microwaves, and a steaming container is arranged at an upper portion of the housing so as to be placed above the water container to cook food contained in the steaming container using the steam generated from the water container.

The water container is open at a top thereof, and a plurality of steam holes are formed on an upper surface of the cooking cavity seating the water container to allow the steam generated from the water container to move into the steaming container.

Two flanges horizontally and outwardly extend from two predetermined positions on an upper edge of the water container, respectively, and two holders are provided at predetermined positions of the upper surface of the cooking cavity to hold the flanges such that the water container is removably supported on the holders.

A top opening is provided at the upper portion of the housing so as to be positioned above the steam holes formed on the upper surface of the cooking cavity, and the steaming container is seated in the top opening, so that the steam passing through the steam holes of the cooking cavity is transmitted to the steaming container through the top opening.

A water supplying guide is placed in the top opening such that the water is supplied to the water container through the water supplying guide to generate the steam in the water container arranged at the upper portion of the cooking cavity.

The water supplying guide includes a bottom portion having a central opening at a central portion thereof, with an upward projecting rim provided along an edge of the central opening to define an outside channel containing water between the upward projecting rim and an outside edge of the bottom portion of the water supplying guide, and a sidewall upwardly extending from the outside edge of the bottom portion of the water supplying guide and provided with a flange outwardly and horizontally extending from an upper edge of the sidewall, wherein the flange is seated on an edge of the top opening so as to be supported at the upper portion of the housing, and the steaming container is seated and supported in the central opening of the water supplying guide.

At least one water supplying hole is formed on a bottom of the outside channel of the water supplying guide, such that the water stored in the water supplying guide is supplied to the water container through the at least one water supplying hole, and a guide hose may be connected to the at least one water supplying hole to guide the water into the water container.

The steaming container includes a body opened at a top thereof to receive food to be cooked, and a lid closing the open top of the body, wherein a plurality of steam holes are formed on a bottom surface of the body to transmit the steam to the food placed in the body.

A food supporting tray is installed in the body of the steaming container so as to be spaced apart from the bottom surface of the body by a predetermined distance and is provided with a plurality of steam holes, with the food to be cooked being placed on the food supporting tray.

The steam holes formed on the bottom surface of the body of the steaming container are bored in lugs upwardly projected from the bottom surface of the body of the steaming container by a predetermined height, and the steam holes formed on the food supporting tray are arranged so as to be eccentric from the steam holes of the body, wherein water and oil produced from the food placed on the food supporting tray pass through the steam holes of the food supporting tray and are then collected on the bottom surface of the body of the steaming container.

The steam holes formed on the bottom surface of the body of the steaming container may be larger, in diameter, than the steam holes formed on the food supporting tray.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
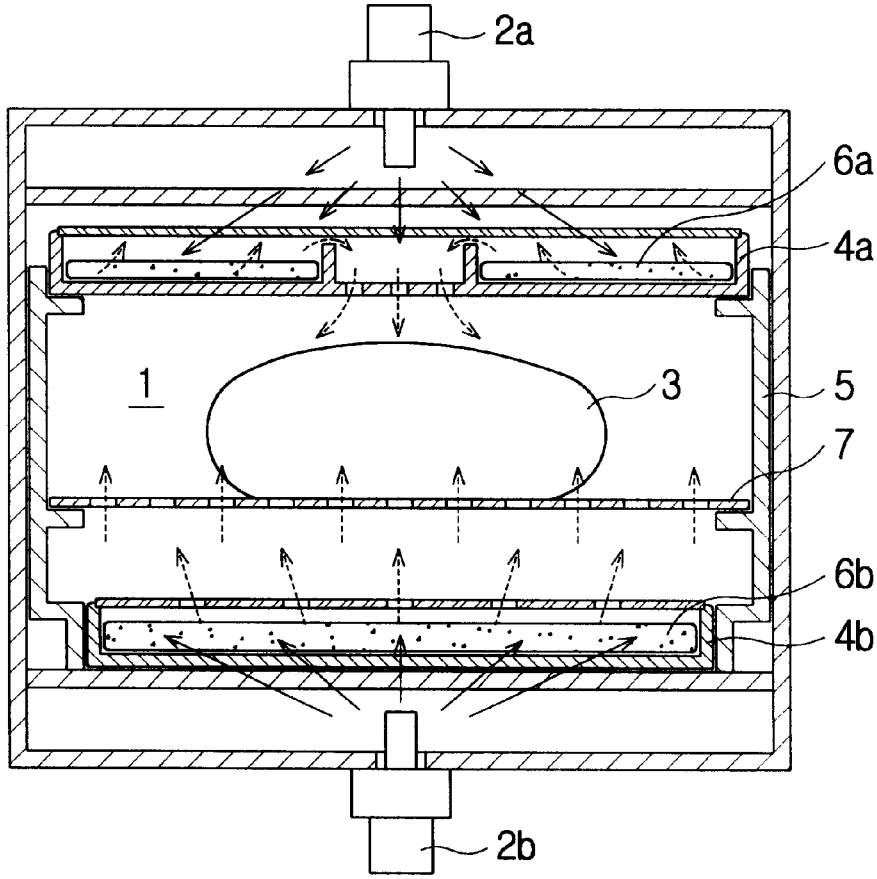
FIG. 1 (PRIOR ART)
FIG. 1 is a schematic sectional view showing a conventional microwave oven, with a steaming container installed in a cooking cavity.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

Figure 2:
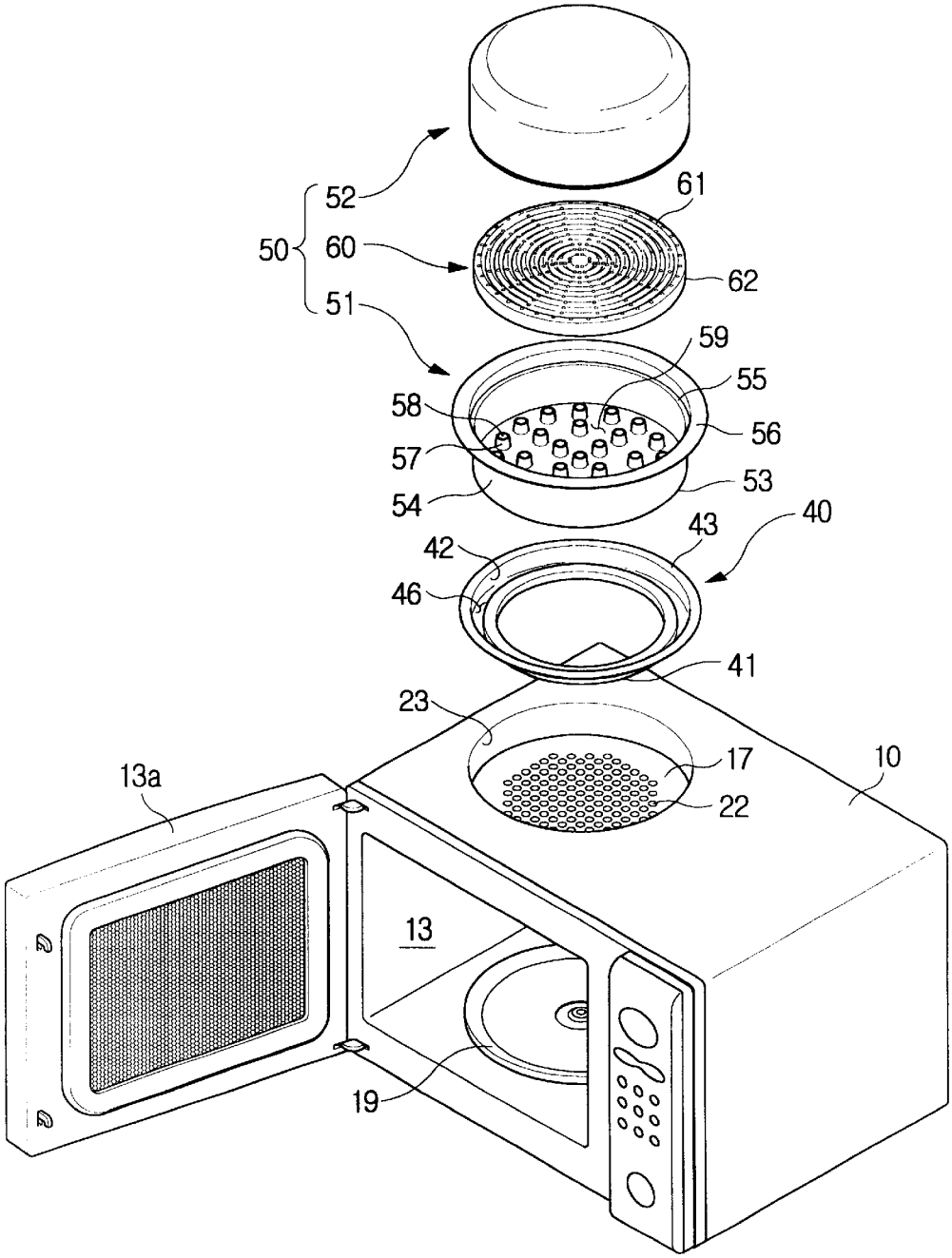
FIG. 2 is an exploded perspective view of a steaming container mounted on an upper portion of a microwave oven according to an embodiment of the present invention.
Figure 3:
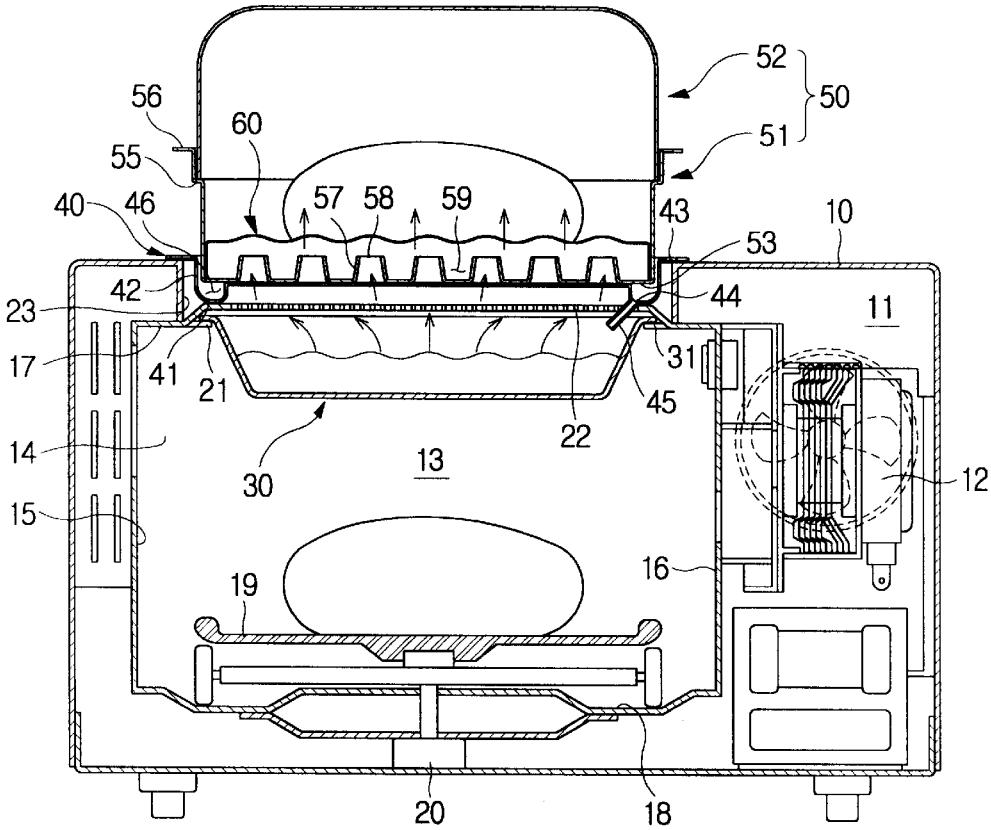
FIG. 3 is a sectional view showing the microwave oven of FIG. 2, with the steaming container and a water container being mounted on an upper portion of a housing and an upper portion of a cooking cavity, respectively.

FIG. 2 is an exploded perspective view of a steaming container mounted on an upper portion of a microwave oven according to an embodiment of the present invention. FIG. 3 is a sectional view showing the microwave oven of FIG. 2, with the steaming container and a water container being mounted on an upper portion of a housing and an upper portion of a cooking cavity, respectively.

As shown in FIGS. 2 and 3, the microwave oven includes a housing 10. The housing 10 defines an appearance of the microwave oven, and is partitioned into a machine room 11 and a cooking cavity 13. The machine room 11 receives electrical devices, including a magnetron 12 to generate microwaves. The cooking cavity 13 defines a space to cook food. The microwaves generated from the magnetron 12 irradiate the cooking cavity 13 to cook the food in the cooking cavity 13.

The cooking cavity 13 is defined by a rear wall 14, a left-side wall 15, a right-side wall 16, an upper surface 17 and a bottom surface 18, and is open at a front of the cooking cavity 13, with a door 13*a* provided at the open front of the cooking cavity 13. The door 13*a* is hinged to an edge of the open front to selectively open or close the cooking cavity 13. A turntable-type cooking tray 19 is installed on the bottom surface 18 of the cooking cavity 13 so that the food to be cooked is placed on the turntable-type cooking tray 19. A motor 20 is installed on a bottom of the housing 10 at a position under the bottom surface 18 of the cooking cavity 13.

A top opening 23 is formed on the upper portion of the housing 10, which encloses the cooking cavity 13 and the machine room 11, so that a steaming container 50, which will be described later herein, is seated in the upper portion of the housing 10.

A water container 30 to generate steam is arranged at the upper surface 17 of the cooking cavity 13 and a steaming container 50 is seated in the top opening 23 of the housing 10.

The water container 30 is designed to contain water therein. The water container 30 is open at a top thereof so as to allow the steam generated from the water in the water container 30 to move upwardly. Two flanges 31 outwardly and horizontally extend from two predetermined positions of an upper edge of the water container 30 and removably engage with two holders 21, respectively, which are provided on the upper surface 17 of the cooking cavity 13 at two predetermined positions.

To removably seat the water container 30 on the upper surface 17 of the cooking cavity 13, the water container 30 is primarily seated on the upper surface 17 of the cooking cavity 13 such that the two flanges 31 and the two holders 21 diverge from each other. Thereafter, when the water container 30 is rotated in a direction, the flanges 31 are brought into an engagement with the holders 21, so that the water container 30 is stably supported on the upper surface 17 of the cooking cavity 13. Further, when the water container 30 is manipulated in a reverse order, the water container 30 is removed from the cooking cavity 13.

A plurality of steam holes 22 are formed on the upper surface 17 of the cooking cavity 13 at a position corresponding to the open top of the water container 30 such that the steam generated from the water contained in the water container 30 moves into the steaming container 50 through the plurality of steam holes 22. Each of the plurality of steam holes 22 has a diameter of about 5 mm or less and an interval between the steam holes 22 is about 3 mm to prevent the microwaves which irradiate the cooking cavity 13 from leaking out of the housing 10 through the plurality of steam holes 22. Further, a number of the steam holes 22 may be 20 or more so as to allow the steam to smoothly flow.

The top opening 23 is formed on the upper portion of the housing 10 in so as to face the upper surface 17 of the cooking cavity 13 on which the plurality of steam holes 22 are formed, so that the steam passing through the plurality of steam holes 22 is supplied into the steaming container 50 which is seated in the top opening 23.

A water supplying guide 40 is removably placed in the top opening 23 to supply the water to the water container 30 positioned in the cooking cavity 13 and to space apart the steaming container 50 from the steam holes 22, thus allowing the steam to be smoothly moved.

The water supplying guide 40 has a size corresponding to the top opening 23, and is provided with a bottom portion 41 and a sidewall 42 upwardly extending from an outside edge of the bottom portion 41 to a predetermined height. The bottom portion 41 of the water supplying guide 40 has a central opening at a central portion thereof. An upward projecting rim is provided along an edge of the central opening. The steaming container 50 is seated on the central portion of the water supplying guide 40 having the central opening, thus being spaced apart from a lower end of the bottom portion 41 of the water supplying guide 40 by a predetermined interval. An outside channel 46 containing the water is defined between the rim and the outside edge of the bottom portion 41. A flange 43 outwardly and horizontally extends from an upper edge of the sidewall 42. In this case, the flange 43 is seated along an upper edge of the top opening 23 to allow the water supplying guide 40 to be removably supported on the upper portion of the housing 10.

At least one water supplying hole 44 is formed on the bottom portion 41 of the water supplying guide 40 such that the water stored in the water supplying guide 40 is supplied to the water container 30 through the at least one water supplying hole 44. A guide hose 45 is connected to the at least one water supplying hole 44 to smoothly guide the water into the water container 30.

The steaming container 50 is seated on the open central portion of the bottom portion 41 of the water supplying guide 40 and is provided with a body 51 and a lid 52. The body 51 has a cylindrical shape which is open at a top thereof to receive the food to be cooked. The lid 52 closes the open top of the body 51 so as to prevent the steam from leaking out.

The body 51 comprises a bottom surface 53 and a sidewall 54 upwardly extending from the edge of the bottom surface 53 to define an interior space. A locking ring 55 is provided around an upper portion of the sidewall 54 such that a lower end of the lid 52 is seated on the locking ring 55. Further, a flange 56 horizontally and outwardly extends from an upper edge of the sidewall 54 by a predetermined length, thus allowing a user to easily carry the body 51.

A plurality of lugs 57 is upwardly projected from the bottom surface 53 of the body 51 so as to be radially arranged on the bottom surface 53 of the body 51. Steam holes 58 are bored in the lugs 57. Thus, the steam generated from the water contained in the water container 30 flows into the steaming container 50 through the steam holes 58 bored in the lugs 57. The water and the oil produced from the food are collected in a collecting space 59 formed on the bottom surface 53 of the body 51 defined by the lugs 57 projected from the bottom surface 53.

The steaming container 50 may be made of a plastic which is harmless to a human body and is heat-resistant. Further, the lid 52 may be transparent so as to allow a user to view an interior of the body 51 through the lid 52, and the body 51 may be opaque so that a user does not view an interior of the housing 10 through the body 51.

A food supporting tray 60 is placed in the body 51 of the steaming container 50 such that the food to be cooked is placed on the food supporting tray 60. The food supporting tray 60 has a diameter slightly smaller than an inner diameter of the body 51 so as to be easily removably mounted in the body 51.

The food supporting tray 60 comprises an upper surface 61 and a sidewall 62. The food to be cooked is placed on the upper surface 61 of the food supporting tray 60. The sidewall 62 of the food supporting tray 60 downwardly extends from an edge of the upper surface 61 of the food support tray 60. Since the sidewall 62 is slightly taller, in height, than each of the lugs 57 projected upward from the bottom surface 53 of the body 51, the upper surface 61 of the food supporting tray 60 is spaced apart from top ends of the lugs 57 when the food supporting tray 60 is seated in the body 51 of the steaming container 50, with the sidewall 62 of the food supporting tray 60 being in contact with the bottom surface 53 of the body 51. A plurality of steam holes 63 is radially arranged on the upper surface 61 of the food supporting tray 60.

Figure 4:
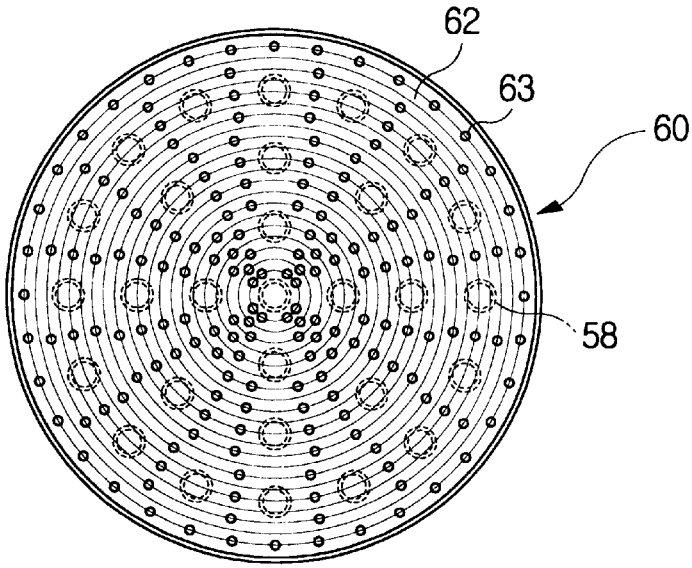
FIG. 4 is a plan view of the steaming container of FIG. 2, when a food supporting tray included in the steaming container of FIG. 2 is seated in the steaming container.

FIG. 4 is a plan view of the steaming container of FIG. 2 when the food supporting tray 60 is seated in the steaming container 50. As shown in FIG. 4, the plurality of steam holes 63 of the food supporting tray 60 are arranged so as to be eccentric from the steam holes 58 formed on the body 51, so the steam holes 63 do not overlap with the steam holes 58. Thus, the water and the oil produced from the food placed on the food supporting tray 60 pass through the steam holes 63 of the food supporting tray 60 and are then collected in the collecting space 59 formed on the bottom surface 53 of the body 51 (see, FIG. 3). Such an eccentric arrangement of the steam holes 58 and 63 allows the water and the oil produced from the food to be collected in the steaming container 50, thus keeping the cooking cavity 13 clean.

Further, the plurality of steam holes 63 of the food supporting tray 60 are smaller, in diameter, than the steam holes 58 formed on the bottom surface 53 of the body 51. The steam holes 58 and 63 are formed to be as numerous as possible so that the steam is uniformly provided to the food to be cooked.

The process of steaming the food using the microwave oven with the steaming container 50 and the water container 30 is as follows.

First, the flanges 31 of the water container 30 are locked to the holders 21 which are provided on the upper surface 17 of the cooking cavity 13. The water supplying guide 40 is seated in the top opening 23 which is formed at the upper portion of the housing 10. Next, the water is supplied to the outside channel 46 provided on the bottom portion 41 of the water supplying guide 40 between the rim and the sidewall 42, so that a predetermined amount of the water is guided into the water container 30 through the guide hose 45.

Thereafter, the food supporting tray 60 is seated in the body 51 of the steaming container 50 so that the steam holes 58 and 63 are eccentric from each other. After placing food to be cooked on the food supporting tray 60, the lid 52 closes the open top of the body 51. Now, a user switches on the microwave oven.

When the microwave oven is operated, the microwaves generated from the magnetron 12 irradiate the cooking cavity 13. At this time, the steam is generated from the water contained in the water container 30 when the water is heated by the microwaves. The steam passes through the steam holes 22 formed on the upper surface 17 of the cooking cavity 13 and the central opening of the water supplying guide 40, and is then transmitted to the bottom of the steaming container 50. Subsequently, the steam passes through the lugs 57 projected from the bottom surface 53 of the steaming container 50 and is fed into the steaming container 50. The steam fed into the steaming container 50 passes through the plurality of small steam holes 63 which is formed on the upper surface 61 of the food supporting tray 60, and is transmitted to the food placed on the food supporting tray 60. As such, the microwave oven allows the food to be steamed. As described above, the water and the oil produced from the food during steaming flows downwards through the steam holes 63 of the food supporting tray 60 and are collected in the collecting space 59 formed on the bottom surface 53 of the body 51.

Since the bottom surface 53 of the steaming container 50 is in close contact with the rim provided along the edge of the central opening of the water supplying guide 40, steam passing through the upper surface 17 of the cooking cavity 13 is transmitted to the steaming container 50 without leaking out through the top opening 23.

When one food is placed on the turntable-type tray 19 during steaming and another food placed on the food supporting tray 60, the food on the turntable-type tray 19 is cooked by the direct-irradiation of the microwaves while the food on the tray 60 is steamed, thus allowing two different kinds of foods to be cooked at one time.

As is apparent from the above description, a microwave oven is provided which is designed, such that a water container generating steam is arranged at an upper surface of a cooking cavity and a steaming container steaming food is arranged at an upper portion of a housing, thus steaming food and cooking food by a direct-irradiation of microwaves at a same time when the microwave oven is operated after laying one food on a turntable-type cooking tray and putting another food in the steaming container, thereby rapidly cooking two different kinds of foods.

Further, a microwave oven is provided, which is designed, such that a collecting space collecting water and oil, produced from food during steaming, is provided on a lower portion of the steaming container, thus keeping a cooking cavity clean, therefore making the microwave oven convenient to use.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven including a housing, and a cooking cavity provided in the housing and openable at a front thereof, comprising:

a water container arranged at an upper portion of the cooking cavity to generate steam from water contained in the water container when heated by microwaves; and a steaming container arranged at an upper portion of the housing so as to be placed adjacent the water container to cook food contained in the steaming container using the steam generated from the water container.

2. The microwave oven as set forth in claim 1, further comprising:

a plurality of steam holes formed on an upper surface of the cooking cavity, wherein the water container is open at a top thereof, and the plurality of steam holes are formed on the upper surface of the cooking cavity seating the water container to allow the steam generated from the water container to move into the steaming container.

3. The microwave oven as set forth in claim 2, wherein each of the plurality of steam holes has a diameter of about 5 mm or less, and an interval between respective steam holes is about 3 mm.

4. The microwave oven as set forth in claim 3, wherein a number of the plurality of steam holes is 20 or more.

5. The microwave oven as set forth in claim 2, further comprising:

two flanges horizontally and outwardly extending from two predetermined positions of an upper edge of the water container, respectively; and two holders provided at predetermined positions of the upper surface of the cooking cavity to engage, respectively, with the two flanges such that the water container is removably supported by the two holders.

6. The microwave oven as set forth in claim 1, wherein the housing comprises:

a top opening provided at an upper portion of the housing so as to be positioned above the plurality of steam holes formed on the upper surface of the cooking cavity, the steaming container being seated in the top opening, so that the steam passing through the plurality of steam holes of the cooking cavity is transmitted to the steaming container through the top opening.

7. The microwave oven as set forth in claim 6, wherein a water supplying guide is placed in the top opening such that the water is supplied to the water container through the water supplying guide to generate the steam in the water container.

8. The microwave oven as set forth in claim 7, wherein the water supplying guide comprises:

a bottom portion having a central opening at a central portion thereof, with an upward projecting rim provided along an edge of the central opening to define an outside channel to contain the water between the upward projecting rim and an outside edge of the bottom portion; and a sidewall upwardly extending from the outside edge of the bottom portion, and provided with a flange outwardly and horizontally extending from an upper edge of the sidewall, wherein the water supplying guide is seated at the flange of the sidewall on an edge of the top opening so as to be supported at the upper portion of the housing, and the steaming container is seated and supported on the central opening of the water supplying guide.

9. The microwave oven as set forth in claim 8, wherein the water supplying guide further comprises:

at least one water supplying hole formed on a bottom of the outside channel of the water supplying guide, such that the water stored in the water supplying guide is supplied to the water container through the at least one water supplying hole.

10. The microwave oven as set forth in claim 9, wherein the water supplying guide further comprises:

at least one guide hose, each guide hose connected to a respective water supplying hole to guide the water into the water container.

11. The microwave oven as set forth in claim 1, wherein the steaming container comprises:

a body opened at a top to receive food to be cooked; and a lid closing the open top of the body of the steaming container, wherein a plurality of steam holes are formed on a bottom surface of the body of the steaming container to transmit the steam to the food contained in the body of the steaming container.

12. The microwave oven as set forth in claim 11, wherein the body of the steaming container comprises:

a food supporting tray comprising:

a plurality of steam holes installed in the body of the steaming container so as to be spaced apart from the bottom surface of the body of the steaming container by a predetermined interval so that food to be cooked is placed on the food support tray.

13. The microwave oven as set forth in claim 12, wherein:

the plurality of steam holes formed on the bottom surface of the body of the steaming container are bored in lugs upwardly projected from the bottom surface of the body of the steaming container by a predetermined height; and the plurality of steam holes formed on the food supporting tray are arranged so as to be eccentric from the plurality of steam holes of the body of the steaming container, wherein water and oil produced from the food placed on the food supporting tray pass through the plurality of steam holes of the food supporting tray and are collected on the bottom surface of the body of the steaming container.

14. The microwave oven as set forth in claim 13, wherein the steam holes formed on the bottom surface of the body of the steaming container are larger, in diameter, than each of the plurality of steam holes formed on the food supporting tray.

15. The microwave oven as set forth in claim 11, wherein the lid is transparent so as to allow a user to view an interior of the body of the steaming container through the lid, and the body is opaque so that the user does not view an interior of the housing through the body of the steaming container.

16. A microwave oven including a housing, and a cooking cavity disposed in the housing, a container disposed in the cooking cavity generating steam when water in the container is heated by microwaves, comprising:

a steaming container disposed at an open portion of the housing so as to be placed adjacent to and to cooperate with the container.

17. A microwave oven as set forth in claim 16, wherein:

the open portion of the housing is provided at an upper portion of the housing; and the steam container cooperates with the container by receiving steam from the container.

18. The microwave oven as set forth in claim 17, further comprising:

a plurality of holes formed at the open portion of the housing to allow the steam generated from the container to move into the steaming container.

19. The microwave oven as set forth in claim 18, further comprising:

a seating portion of the cooking cavity, wherein the steaming container is removably seated in the seating portion of the cooking cavity such that when the steaming container is seated in the seating portion the steam generated from the container moves into the steaming container.

20. The microwave oven as set forth in claim 18, wherein each of the plurality of holes has a diameter to prevent leakage of the microwaves radiated to the cooking cavity.

21. The microwave oven as set forth in claim 18, wherein each of the plurality of holes has a diameter of about 5 mm or less, and an interval between respective holes is about 3 mm.

22. The microwave oven as set forth in claim 21, wherein a number of the plurality of holes is 20 or more.

23. The microwave oven as set forth in claim 19, wherein the seating portion comprises:

a plurality of flanges extending from predetermined positions of an upper edge of the container; and a plurality of holders provided at predetermined positions of an upper surface of the cooking cavity to engage with respective flanges such that the container is removably seated on the plurality of holders.

24. The microwave oven as set forth in claim 17, further comprising:

a water supplying guide placed in the open portion of the housing such that water is supplied to the container through the water supplying guide to generate steam in the container.

25. The microwave oven as set forth in claim 24, wherein the water supplying guide comprises:

a bottom portion with a channel to contain the water; and a sidewall upwardly extending from an outside edge of the bottom portion, and provided with a flange outwardly and horizontally extending from an upper edge of the sidewall, wherein the water supplying guide is seated at the flange of the sidewall on an edge of the open portion so as to be supported at the upper portion of the housing.

26. The microwave oven as set forth in claim 25, wherein the water supplying guide further comprises:

one or more water supplying holes formed on a bottom of the channel of the water supplying guide such that the water in the water supplying guide is supplied to the container through the one or more water supplying holes; and one or more hoses, each connected at a respective water supplying hole to guide the water into the container.

27. The microwave oven as set forth in claim 16, wherein the steaming container comprises:

a body opened at a top thereof to receive food to be cooked; and a lid closing the open top of the body of the steaming container, wherein a plurality of steam holes are formed on a bottom surface of the body of the steaming container to transmit steam to the food contained in the body of the steaming container.

28. The microwave oven as set forth in claim 27, wherein the body of the steaming container further comprises:

a support tray spaced apart from the bottom surface of the body of the steaming container and provided with a plurality of steam holes therein such that the food to be cooked is placeable on the supporting tray.

29. The microwave oven as set forth in claim 28, wherein the plurality of steam holes of the body of the steaming container are integrally formed on the bottom surface of the body of the steaming container and upwardly project from the bottom surface of the body of the steaming container by a predetermined height.

30. The microwave oven as set forth in claim 28, wherein the plurality of steam holes of the body of the steaming container and the plurality of steam holes formed on the supporting tray are vertically misaligned.

31. The microwave oven as set forth in claim 28, wherein a diameter of each of the plurality of steam holes formed on the body of the steaming container are larger than a diameter of each of the plurality the steam holes formed on the supporting tray.

32. The microwave oven as set forth in claim 27, wherein:

the lid of the steaming container is transparent; and the body of the steaming container is opaque.

33. The microwave oven as set forth in claim 27, wherein the steam container is made of a heat-resistant plastic.

34. The microwave oven as set forth in claim 28, wherein the supporting tray has a diameter smaller than a diameter of the body of the steaming container so as to be removably mounted in the body of the steaming container.

35. A microwave oven including a housing, and a cooking cavity disposed in the housing, a container disposed in the cooking cavity generating steam when water in the container is heated by microwaves, comprising:

a steaming container disposed at an open portion of the housing so as to be removably seated on the microwave oven and accessible from an exterior thereof and when seated is supplied with steam generated from the container in the cooking cavity.

36. A method of cooking using a microwave oven including a housing, and a cooking cavity disposed in the housing, a container disposed in the cooking cavity generating steam, when water in the container is heated by microwaves comprising:

cooking one food placed in a cooking cavity from direct irradiation by the microwaves; and cooking another food placed in a steaming container, while simultaneously cooking the one food, by steam generated from the container in the cooking cavity, the steaming container being removably seated on the microwave oven and accessible from an exterior thereof.

37. A microwave oven including a cooking cavity disposed therein, comprising:

a turntable-type tray disposed in the cooking cavity, one food to be cooked by the direct-irradiation of microwaves is placed on the turntable-type tray; and a food supporting tray disposed in or adjacent to the cooking cavity, another food to be steamed by water irradiated by microwaves, is placed in said supporting tray wherein the microwave oven allows two different kinds of foods to be cooked at one time.

38. A method of cooking using a microwave oven including a cooking cavity disposed therein, comprising:

cooking one food by the direct-irradiation of microwaves placed on a turntable-type tray of the cooking cavity; and steaming another food by water irradiated by microwaves placed on a food supporting tray, wherein the microwave oven allows two different kinds of foods to be cooked at one time.

* * * * *